US008151892B2

(12) United States Patent
Williams et al.

(10) Patent No.: US 8,151,892 B2
(45) Date of Patent: Apr. 10, 2012

(54) WELLHEAD CONVERSION SYSTEM AND METHOD

(75) Inventors: Gregory Williams, Houston, TX (US); James Bower, Deer Park, TX (US)

(73) Assignee: Dril-Quip, Inc., Houston, TX (US)

( * ) Notice: Subject to any disclaimer, the term of this patent is extended or adjusted under 35 U.S.C. 154(b) by 307 days.

(21) Appl. No.: 12/399,050

(22) Filed: Mar. 6, 2009

(65) Prior Publication Data

US 2010/0224373 A1 Sep. 9, 2010

(51) Int. Cl.
*E21B 19/00* (2006.01)

(52) U.S. Cl. ..... 166/379; 166/85.5

(58) Field of Classification Search ..... 166/85.5, 166/379, 341

See application file for complete search history.

(56) References Cited

U.S. PATENT DOCUMENTS

| | | | | | |
|---|---|---|---|---|---|
| 3,322,192 | A * | 5/1967 | Woelfel et al. | ..... | 166/368 |
| 3,353,595 | A * | 11/1967 | Gruller et al. | ..... | 166/341 |
| 3,419,071 | A * | 12/1968 | Williams, Jr. et al. | ..... | 166/346 |
| 3,500,906 | A * | 3/1970 | Petersen | ..... | 166/341 |
| 3,603,401 | A * | 9/1971 | Nelson et al. | ..... | 166/313 |
| 5,145,006 | A * | 9/1992 | June | ..... | 166/341 |
| 5,372,199 | A * | 12/1994 | Cegielski et al. | ..... | 166/368 |
| 5,503,230 | A * | 4/1996 | Osborne et al. | ..... | 166/344 |
| 5,975,210 | A * | 11/1999 | Wilkins et al. | ..... | 166/341 |
| 6,408,949 | B1 * | 6/2002 | Aquilera et al. | ..... | 166/368 |
| 6,557,638 | B2 * | 5/2003 | Cunningham et al. | ..... | 166/348 |
| 2007/0007012 | A1 * | 1/2007 | Bartlett et al. | ..... | 166/344 |

OTHER PUBLICATIONS

Merriam-Webster Dictionary definition of "slot" accessed Mar. 3, 2011 via m-w.com.*

* cited by examiner

*Primary Examiner* — Daniel P Stephenson
*Assistant Examiner* — Blake Michener
(74) *Attorney, Agent, or Firm* — Baker Botts L.L.P.

(57) ABSTRACT

Methods and systems relating to subsea wellhead orientation are disclosed. A system may include a wellhead with an orientation key on an outer surface and an opening on an inner surface and a Christmas tree attached to a guide tube having an orientation profile which engages the orientation key and guides the Christmas tree into a desired orientation relative to the wellhead. The system may also include a lockdown sleeve with a mating profile on an inner surface, and a protuberance on an outer surface which engages the opening on the inner surface of the wellhead when the lockdown sleeve is in a desired orientation relative to the wellhead. In addition, the system may include a tubing hanger with a mating profile on an outer surface which engages the mating profile of the lockdown sleeve and guides the tubing hanger into a desired orientation relative to the lockdown sleeve.

16 Claims, 5 Drawing Sheets

WELLHEAD CONVERSION SYSTEM AND METHOD

BACKGROUND

The present invention relates to subsea wellhead orientation, and more particularly, in certain embodiments, to methods and systems for aligning a Christmas tree with a tubing hanger.

Tubing hangers need a specific orientation with respect to the wellhead because they contain numerous bores, which require alignment with corresponding portions of respective Christmas trees. Conventionally, there are two ways to achieve orientation of a Christmas tree relative to a tubing hanger. The first uses a tubing spool assembly, which latches to the wellhead and provides landing and orientation features. The tubing spool is very expensive and adds height to the overall stack-up. Additionally, the tubing spool is so heavy that very few work class vessels can install it, and it frequently requires installation by expensive drilling vessels. Furthermore, the drilling riser must be removed to install the tubing spool.

The second method of orienting a Christmas tree relative to a tubing hanger involves the use of a blowout preventer ("BOP") stack hydraulic pin and orientation adapter joint. This method requires detailed knowledge of the particular BOP stack in order to accurately install a hydraulically actuated pin, which protrudes into the BOP stack bore. An orientation helix is attached above the tubing hanger running tool, and, as the tubing hanger lands, the helix engages the hydraulic pin and orientates the tubing bores to a defined direction. This method requires accurate drawings of the BOP stack elevations and spacing between the main bore and the outlet flanges, which may require hours of surveying and multiple trips to make measurements. Tremendous room for error exists with this method, particularly in older rigs. Thus, this method requires significant up front planning. Additionally, setting the lockdown sleeve in the wellhead generally requires a rig because the BOP must remain in place as a reference point for orientation of the tubing hanger and corresponding lockdown sleeve.

SUMMARY

The present invention relates to subsea wellhead orientation, and more particularly, in certain embodiments, to methods and systems for aligning a Christmas tree with a tubing hanger.

One embodiment of the present invention provides a method of aligning a Christmas tree with a tubing hanger. The method comprises the step of providing a wellhead with an orientation key on an outer surface and an opening on an inner surface. The method further comprises the step of providing the Christmas tree attached to a guide tube having an orientation profile configured to engage the orientation key and guide the Christmas tree into a desired orientation relative to the wellhead. The method further comprises the step of providing a lockdown sleeve with a mating profile on an inner surface, and a protuberance on an outer surface configured to engage the opening on the inner surface of the wellhead when the lockdown sleeve is in a desired orientation relative to the wellhead. The method further comprises providing the tubing hanger with a mating profile on an outer surface configured to engage the mating profile of the lockdown sleeve and guide the tubing hanger into a desired orientation relative to the lockdown sleeve. The method further comprises moving the lockdown sleeve into engagement with the wellhead. The method further comprises moving the tubing hanger into engagement with the lockdown sleeve. The method further comprises moving the Christmas tree into engagement with the wellhead and the tubing hanger.

Another embodiment provides a system for aligning a Christmas tree with a tubing hanger. The system comprises a wellhead with an orientation key on an outer surface and an opening on an inner surface. The system further comprises the Christmas tree attached to a guide tube having an orientation profile configured to engage the orientation key and guide the Christmas tree into a desired orientation relative to the wellhead. The system further comprises a lockdown sleeve with a mating profile on an inner surface, and a protuberance on an outer surface configured to engage the opening on the inner surface of the wellhead when the lockdown sleeve is in a desired orientation relative to the wellhead. The system further comprises the tubing hanger with a mating profile on an outer surface configured to engage the mating profile of the lockdown sleeve and guide the tubing hanger into a desired orientation relative to the lockdown sleeve.

The features and advantages of the present invention will be readily apparent to those skilled in the art. While those skilled in the art may make numerous changes, such changes are within the spirit of the invention.

DETAILED DESCRIPTION OF THE DRAWINGS

Figure 1:
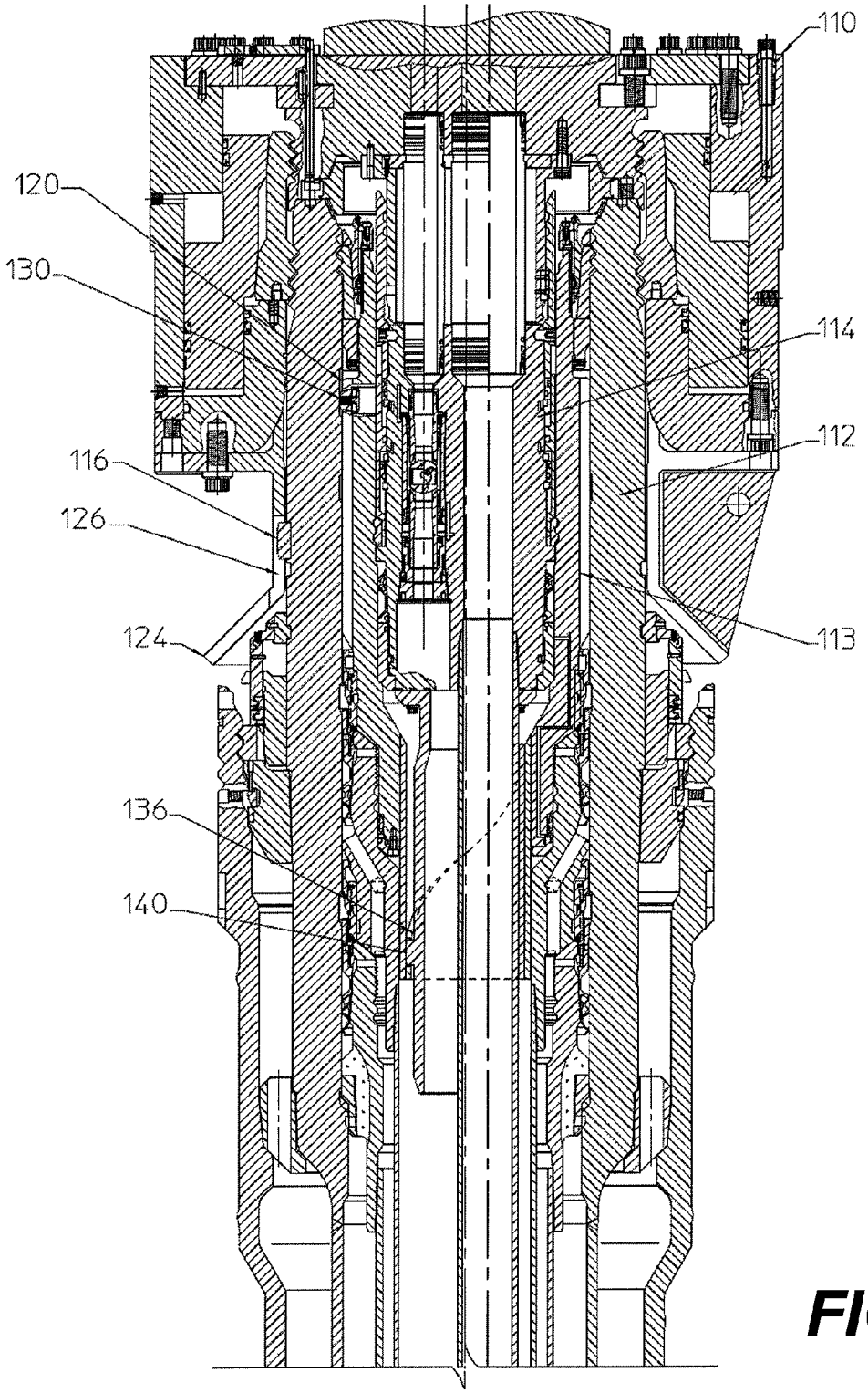
FIG. 1 illustrates a cross section of a system for aligning a Christmas tree with a tubing liner in accordance with certain embodiments of the present invention.
Figure 2:
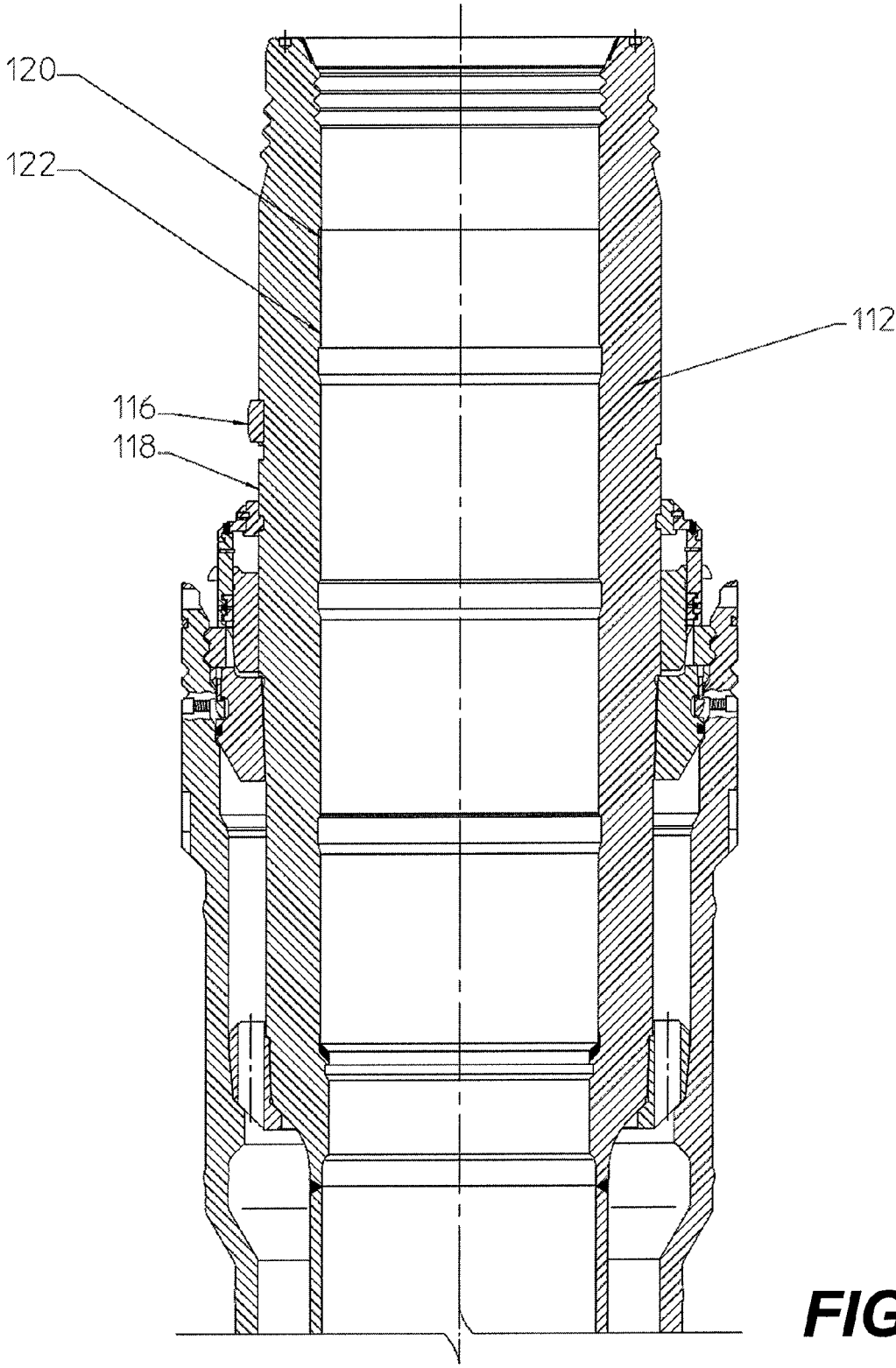
FIG. 2 illustrates a cross section of a wellhead in accordance with certain embodiments of the present invention.

Referring to FIG. 1, various elements may assist in achieving proper alignment of Christmas tree 110 on wellhead 112 and with lockdown sleeve 113 and tubing hanger 114. Referring to FIG. 2, wellhead 112 may have orientation key 116 on outer surface 118 and opening 120 on inner surface 122. Orientation key 116 on outer surface 118 of wellhead 112 may provide a visual indication of the orientation of wellhead 112 on the installation. Orientation key 116 may be male, and protrude from wellhead 112 as illustrated, for greater visibility and/or use in aligning Christmas tree 110 (illustrated in FIG. 1). Alternatively, orientation key 116 may be female or a helix, depending on the particular conditions. Opening 120 may have a fixed position on wellhead 112 relative to orientation key 116, such that even when opening 120 is not visible, its position is known. For example, but not by way of limitation, opening 120 may radially align with orientation key 116. Opening 120 may be a round hole, a square hole, a rectangular hole, a slot, or any other suitable opening, as will be appreciated by those skilled in the art.

Figure 3:
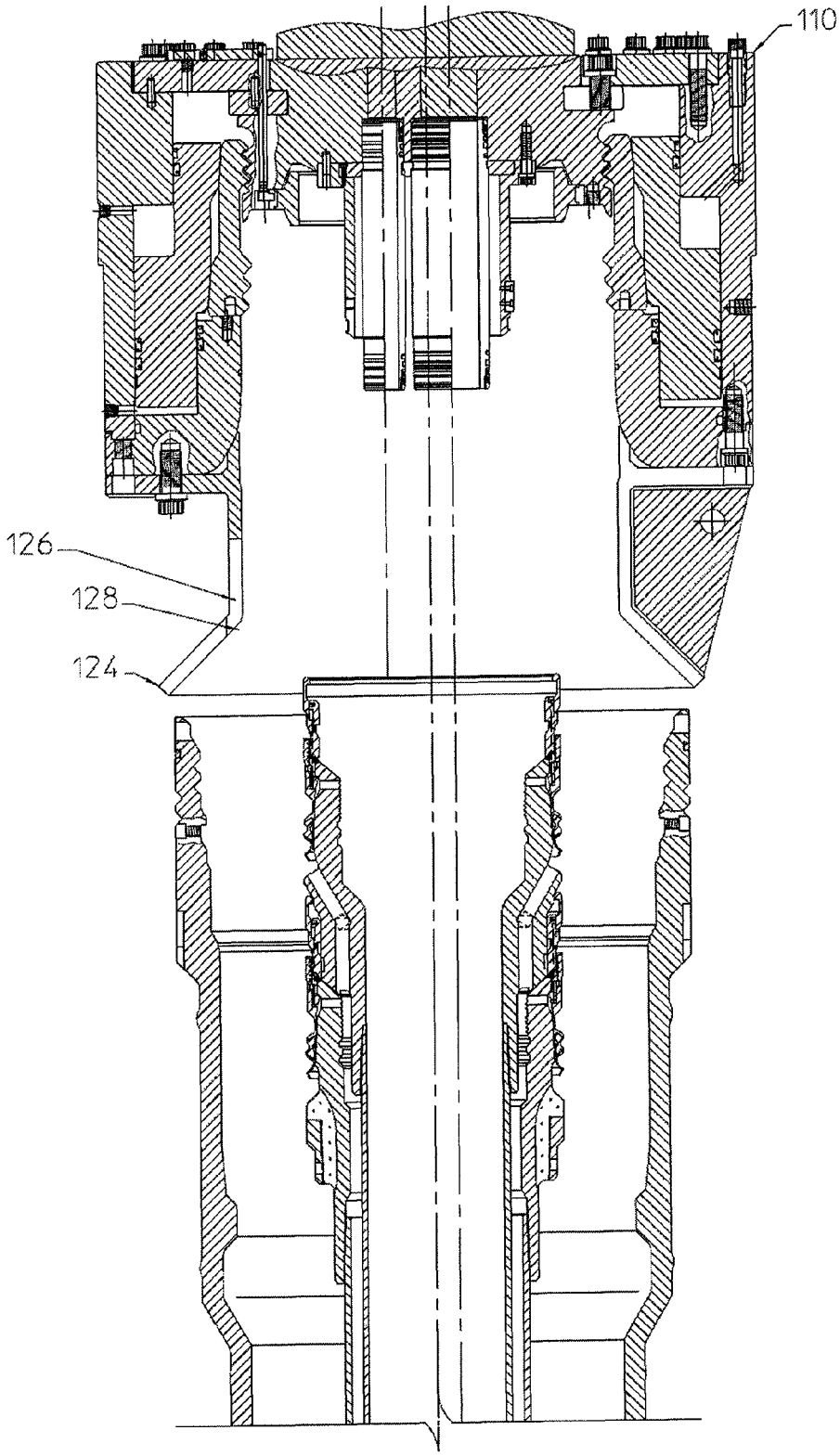
FIG. 3 illustrates a cross section of a Christmas tree in accordance with certain embodiments of the present invention.

Referring now to FIG. 3, guide tube 124 may attach to a lower end of Christmas tree 110 in any number of ways, including, for example, a bolted connection. Guide tube 124 may have orientation profile 126 on inner surface 128. Orientation profile 126 may be configured to engage orientation key 116 of wellhead 112 (not shown in FIG. 3) and thereby guide Christmas tree 110 into a desired orientation relative to wellhead 112. Orientation profile 126 may have a fixed position relative to the rest of Christmas tree 110, such that proper alignment of orientation profile 126 necessarily results in proper alignment of Christmas tree 110. Orientation profile 126 may be female, such as a round hole, a square hole, a rectangular hole, a slot, or any other suitable opening, as will be appreciated by those skilled in the art. Alternatively, orientation profile 126 may be male, having a protrusion when orientation key 116 is an opening, a helix, or the like. In an embodiment as illustrated, orientation profile 126 is a tapered slot through which orientation key 116 may pass. The slot may be wider at a bottom end of guide tube 124, which may allow for a margin of error when aligning orientation key 116 and the slot. The slot may narrow toward an upper portion Christmas tree 110, such that orientation key 116 fits tightly near a top of the slot when Christmas tree 110 is engaged in a desired orientation with wellhead 112. In addition to the tapered slot, the shape of guide tube 124 may also allow for a margin of error when aligning with wellhead 112. Thus, guide tube 124 may be funnel-shaped with a wider portion at a bottom end and a narrower portion closer to Christmas tree 110.

Figure 4:
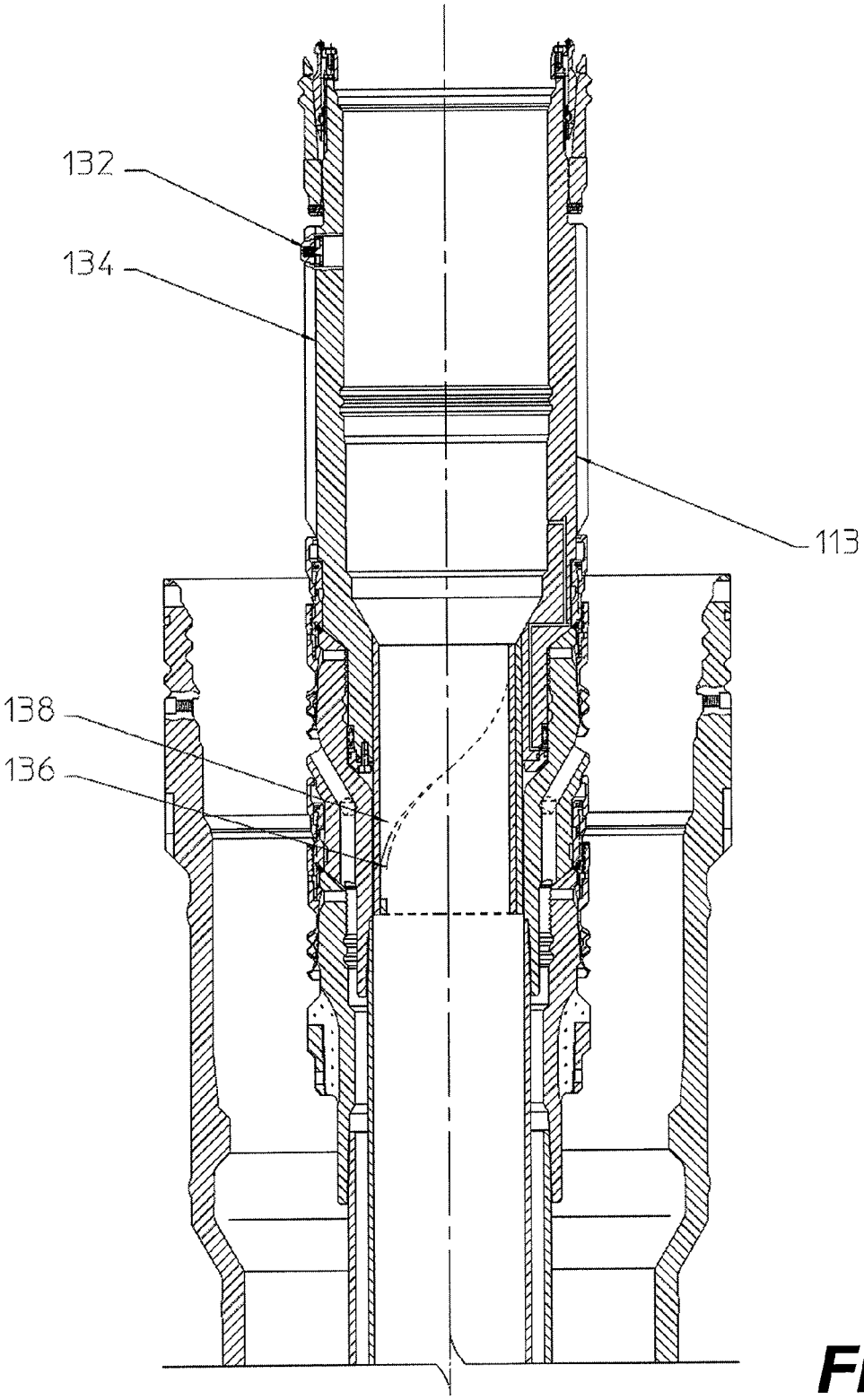
FIG. 4 illustrates a cross section of a lockdown sleeve in accordance with certain embodiments of the present invention.

Lockdown sleeve 113 may fit within wellhead 112. Referring now to FIG. 4, lockdown sleeve 113 may have protuberance 132 on outer surface 134. Protuberance 132 may be a spring loaded anti-rotation key, or any of a number of other projections capable of engaging opening 120 on inner surface 122 of wellhead 112 (not shown in FIG. 4) when lockdown sleeve 113 is fully and properly engaged in a desired orientation. In some embodiments, multiple protuberances may be used in various configurations to mate with multiple openings. In some embodiments, two protuberances and respective openings may be placed, sized, or shaped such that only one orientation is possible. For example, an offset angle between two protuberances may be an angle other than 180°, with only one orientation allowing engagement between lockdown sleeve 113 and wellhead 112. Alternatively, two or more protuberances may have different shapes that correspond to shapes of the respective openings. Other configurations of protuberances and corresponding openings fall within the spirit of this invention.

In addition to protuberance 132 on outer surface 134, lockdown sleeve 113 may have mating profile 136 on inner surface 138 for engaging tubing hanger 114 (not shown in FIG. 4). In some embodiments, protuberance 132 may radially align with mating profile 136. The Figures show mating profile 136 as a bolted attachment at a lower end of lockdown sleeve 113. However, those skilled in the art will appreciate other suitable configurations. Mating profile 136 may have a fixed position on lockdown sleeve 113 relative to protuberance 132, such that proper orientation of protuberance 132 necessarily results in proper orientation of the mating profile 136. Mating profile 136 may be a helix, a lug, a protuberance, or any other profile configured to mate with tubing hanger 114 in a desired orientation.

Figure 5:
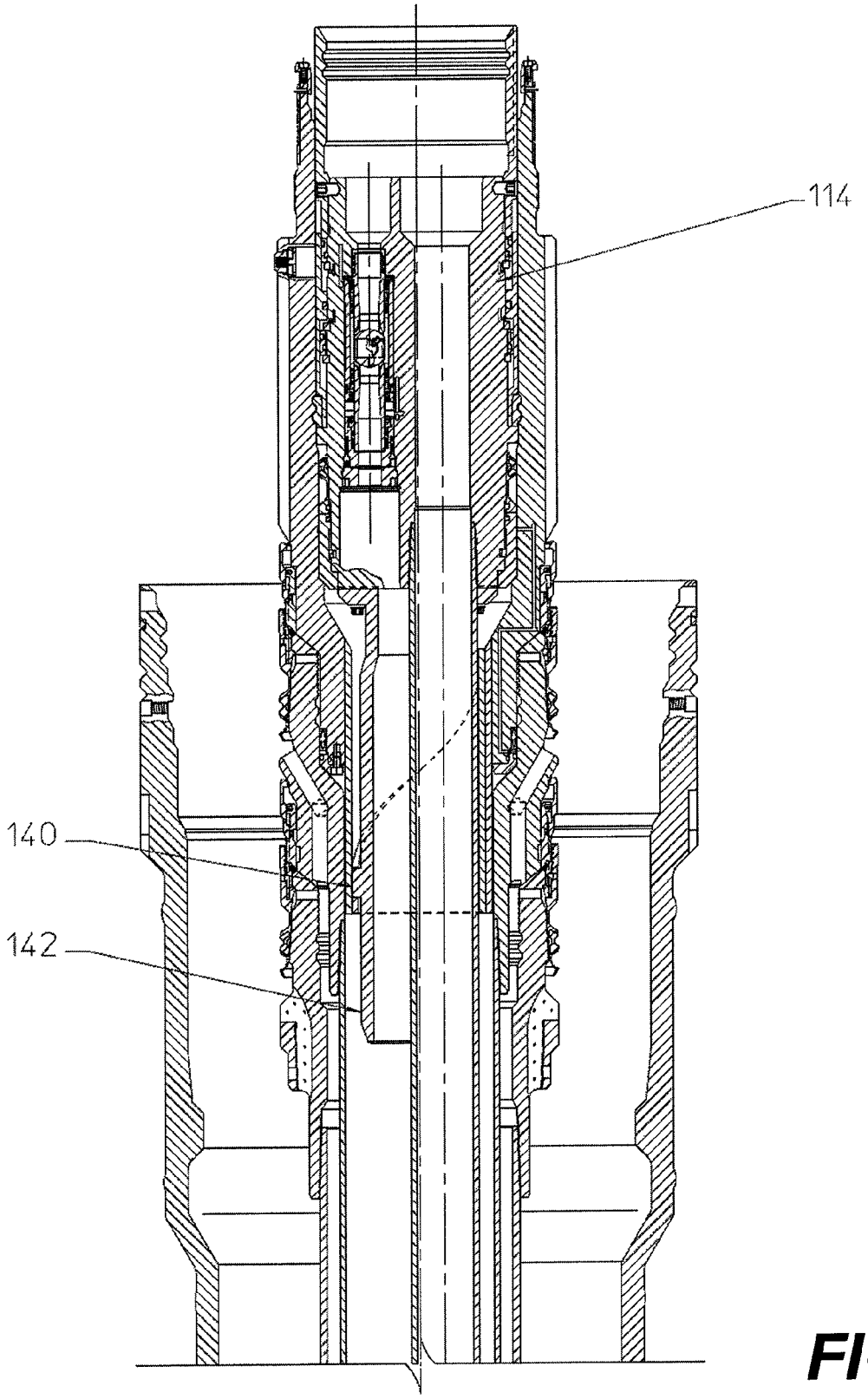
FIG. 5 illustrates a cross section of a tubing hanger in accordance with certain embodiments of the present invention.

Referring now to FIG. 5, tubing hanger 114 may have a mating profile 140 on outer surface 142 for engaging lockdown sleeve 113 (not shown in FIG. 5). Mating profile 140 may be a lug, a helix, an opening, or any other profile configured to engage the mating profile of lockdown sleeve 113 and guide the tubing hanger into a desired orientation. FIG. 1 illustrates mating profile 136 as a helix and mating profile 140 as a lug. Additionally, mating profile 140 is illustrated as a bolted attachment of tubing hanger 114. However, those skilled in the art will appreciate other suitable configurations. In this embodiment, as the tubing hanger 114 moves into lockdown sleeve 113, the lug engages the helix and guides the tubing hanger 114 to rotate into a desired orientation within lockdown sleeve 113. Those skilled in the art will appreciate that the helix could be on tubing hanger 114 and the lug could be on lockdown sleeve 113 with similar results.

Using the methods of certain embodiments of the present invention, installing Christmas tree 110 on wellhead 112 in alignment with tubing hanger 114 may allow for automatic alignment of Christmas tree 110 with tubing hanger 114. Referring again to FIG. 1, wellhead 112 may move into position before lockdown sleeve 113. A workboat or diving vessel may lower lockdown sleeve 113 into wellhead 112 and rotate or otherwise move lockdown sleeve 113 until protuberance 132 engages opening 120 of wellhead 112, and lockdown sleeve 113 is in desired engagement with wellhead 112. Because the orientation of opening 120 may be known relative to orientation key 116, when protuberance 132 engages opening 120, orientation of protuberance 132 may be known relative to orientation key 116. Likewise, because orientation of mating profile 136 may be known relative to protuberance 132, the orientation of mating profile 136 may be known relative to orientation key 116.

Tubing hanger 114 may move into lockdown sleeve 113 and rotate or otherwise move until mating profile 140 on tubing hanger 114 engages mating profile 136 on lockdown sleeve 113. The two mating profiles 136 and 140 may then cause tubing hanger 114 to move into desired engagement with lockdown sleeve 113. Because the orientation of mating profile 136 may be known relative to orientation key 116, when mating profile 136 engages mating profile 140 on tubing hanger 114, the orientation of mating profile 140 may be known relative to orientation key 116. Thus, tubing hanger 114 may have a known orientation relative to wellhead 112.

Christmas tree 110, with guide tube 124 may move onto wellhead 112 and rotate or otherwise move until orientation profile 126 engages orientation key 116. Orientation key 116 and orientation profile 126 may then cause Christmas tree 110 to move into desired engagement with wellhead 112. Because the orientation of tubing hanger 114 may be known relative to the orientation key 116, when the orientation key 116 and the orientation profile 126 engage, the orientation of tubing hanger 114 may be known relative to Christmas tree 110. Thus, Christmas tree 110 may easily move into desired engagement in a proper orientation with tubing hanger 114.

Known values of orientation key 116, opening 120, orientation profile 126, protuberance 132, mating profile 136, and mating profile 140 may be used to calculate the orientation of tubing hanger 114, allowing Christmas tree 110 to be properly positioned. Alternatively, one or more of orientation key 116, opening 120, orientation profile 126, protuberance 132, mating profile 136, and mating profile 140 may be positioned such that Christmas tree 110 is automatically positioned properly. In yet other embodiments, orientation key 116, opening 120, orientation profile 126, protuberance 132, mating profile 136, and mating profile 140 may all be radially aligned such that Christmas tree 110 is automatically positioned properly.

Thus, alignment of tubing hanger 114, lockdown sleeve 113, wellhead 112, and Christmas tree 110 may be set in a desired orientation without the need for extraneous alignment devices. Rather, modifications of existing tubing hangers, lockdown sleeves, wellheads, and Christmas trees may allow for an improved method of obtaining a desired alignment. For example, a slim bore (13½" nominal size) tubing hanger may be installed into a standard bore (18¾" nominal size) wellhead and achieve a defined orientation of all the tubing hanger through bores and downhole control lines with respect to the wellhead. A lockdown sleeve may be installed prior to the tubing hanger and provide a passive orientation helix which uses the weight of the production tubing to align the tubing hanger prior to landing. As noted above, the lockdown sleeve may have a spring-loaded key, which may engage a slot in the bore of the wellhead, and a fixed key on the outside of the wellhead may align and guide the Christmas tree into the correct orientation so that all the Christmas tree stabs engage the tubing hanger bores correctly. In some embodiments, the helix key in the tubing hanger, the spring-loaded key in the lockdown sleeve, and the fixed key on the outside of the wellhead may all be aligned with one another, allowing orientation to be verified visually from outside the subsea wellhead.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, many of the features could be moved to different locations on respective parts without departing from the spirit of the invention. Furthermore, no limitations are intended to be limited to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A method of aligning a Christmas tree with a tubing hanger, comprising:

providing a wellhead with an orientation key on an outer surface and an opening on an inner surface;

providing the Christmas tree attached to a guide tube having an orientation profile configured to engage the orientation key and guide the Christmas tree into a desired radial orientation relative to the wellhead;

providing a lockdown sleeve with a first mating profile on an inner surface, and a protuberance on an outer surface configured to engage the opening on the inner surface of the wellhead when the lockdown sleeve is in a desired orientation relative to the wellhead;

providing the tubing hanger with a second mating profile on an outer surface configured to engage the first mating profile and guide the tubing hanger into a desired orientation relative to the lockdown sleeve;

moving the lockdown sleeve into engagement with the wellhead;

after the lockdown sleeve is in engagement with the wellhead, moving the tubing hanger into engagement with the lockdown sleeve; and after the tubing hanger is in engagement with the lockdown sleeve, moving the Christmas tree into engagement with the wellhead and the tubing hanger;

wherein the Christmas tree is radially aligned with the tubing hanger once the Christmas tree is moved into engagement with the wellhead and the tubing hanger.

2. The method of aligning a Christmas tree with a tubing hanger of claim 1, wherein the orientation profile is a tapered slot.

3. The method of aligning a Christmas tree with a tubing hanger of claim 1, wherein the guide tube is funnel-shaped.

4. The method of aligning a Christmas tree with a tubing hanger of claim 1, wherein the protuberance is a spring-loaded key.

5. The method of aligning a Christmas tree with a tubing hanger of claim 1, wherein the orientation key is male and the orientation profile is female.

6. The method of aligning a Christmas tree with a tubing hanger of claim 1, wherein the first mating profile is at a lower end of the lockdown sleeve.

7. The method of aligning a Christmas tree with a tubing hanger of claim 1, wherein the first mating profile is a bolted attachment to the lockdown sleeve.

8. The method of aligning a Christmas tree with a tubing hanger of claim 1, wherein the first mating profile is a helix and the second mating profile is a lug.

9. A system aligning a Christmas tree with a tubing hanger, comprising:

a wellhead with an orientation key on an outer surface and an opening on an inner surface;

the Christmas tree attached to a guide tube having an orientation profile configured to engage the orientation key and guide the Christmas tree into a desired radial orientation relative to the wellhead;

a lockdown sleeve with a first mating profile on an inner surface, and a protuberance on an outer surface configured to engage the opening on the inner surface of the wellhead when the lockdown sleeve is in a desired orientation relative to the wellhead; and the tubing hanger with a second mating profile on an outer surface configured to engage the first mating profile and guide the tubing hanger into a desired orientation relative to the lockdown sleeve;

wherein one or more of the orientation key, the opening, the orientation profile, the protuberance, the first mating profile, and the second mating profile are configured so that the Christmas tree is radially aligned with the tubing hanger once the Christmas tree is engaged with the wellhead and wherein the opening on the inner surface of the wellhead is radially aligned with the orientation key on the outer surface of the wellhead.

10. The system for aligning a Christmas tree with a tubing hanger of claim 9, wherein the orientation profile is a tapered slot.

11. The system for aligning a Christmas tree with a tubing hanger of claim 9, wherein the guide tube is funnel-shaped.

12. The system for aligning a Christmas tree with a tubing hanger of claim 9, wherein the protuberance is a spring-loaded key.

13. The system for aligning a Christmas tree with a tubing hanger of claim 9, wherein the orientation key is male and the orientation profile is female.

14. The system for aligning a Christmas tree with a tubing hanger of claim 9, wherein the first mating profile is at a lower end of the lockdown sleeve.

15. The system for aligning a Christmas tree with a tubing hanger of claim 9, wherein the first mating profile is a bolted attachment to the lockdown sleeve.

16. The system for aligning a Christmas tree with a tubing hanger of claim 9, wherein the first mating profile is a helix and the second mating profile is a lug.

* * * * *